United States Patent [19]

Kollberg et al.

[11] 4,173,299

[45] Nov. 6, 1979

[54] ELECTROMAGNETIC VALVE WITH SLAG INDICATOR

[75] Inventors: Sten Kollberg, Vasteras; Lars Tiberg, Fagersta, both of Sweden

[73] Assignee: ASEA AB, Vasteras, Sweden

[21] Appl. No.: 845,366

[22] Filed: Oct. 25, 1977

[30] Foreign Application Priority Data

Oct. 25, 1976 [SE] Sweden ..... 7611806

[51] Int. Cl.[2] ..... B22D 37/00

[52] U.S. Cl. ..... 222/594; 73/304 R; 137/827; 164/4; 164/155; 164/251; 324/204

[58] Field of Search ..... 324/204; 310/11; 335/215, 219; 266/237; 222/590, 594, 597; 137/827; 164/4, 49, 150, 155, 251

[56] References Cited

U.S. PATENT DOCUMENTS

| | | | |
|---|---|---|---|
| 2,743,492 | 5/1956 | Easton | 164/449 X |
| 3,002,383 | 10/1961 | Mittelmann | 324/204 X |
| 3,078,412 | 2/1963 | Blake | 324/204 X |
| 3,299,706 | 1/1967 | Bailey et al. | 73/304 R |
| 3,370,466 | 2/1968 | Chang | 73/304 R |
| 3,701,357 | 10/1972 | Granström | 137/827 |
| 4,037,761 | 7/1977 | Kemlo et al. | 222/590 |

FOREIGN PATENT DOCUMENTS

| | | | |
|---|---|---|---|
| 4536678 | 11/1970 | Japan | 222/594 |

*Primary Examiner*—David A. Scherbel
*Attorney, Agent, or Firm*—Watson, Cole, Grindle & Watson

[57] ABSTRACT

A valve device for metallurgical containers includes an electric circuit formed by two electrodes opening out into the molten metal at the tapping point. The electric circuit measures the resistive voltage drop across the molten metal at the tapping point to determine the slag content in the tap stream by changes in the measured resistive voltage drop. The rate of tapping of the melt can be controlled simultaneously along with the indication of the presence of slag in the tap stream.

2 Claims, 2 Drawing Figures

ELECTROMAGNETIC VALVE WITH SLAG INDICATOR

BACKGROUND OF THE INVENTION

1. Field of the Invention

The present invention relates to valve devices used in connection with tapping points from metallurgical containers.

In casting operations it would be of great value to have a signal indicating when the surface of the bath has declined to the point that slag starts streaming out from the tap hole. A vortex is normally formed above the tap hole and sucks down the slag from the surface of the bath, and therefore considerable amounts of slag are suddenly drawn down into the tap stream. The requirements for accuracy of the measurement signal from a slag indicator are therefore moderate.

SUMMARY OF THE INVENTION

The invention provides a solution to the aforementioned problem and other associated problems whereby an electric circuit is formed by two electrodes opening out into the molten metal at the tapping point (the tap stream). The electric circuit is provided with means for measuring the resistive voltage drop across the molten metal at the tapping point. Any change in this resistive voltage drop is a measure of any slag content in the tap stream. Since the resistivity of molten slag and molten iron are quite different and, in addition, the tap stream completely fills the cavity adjacent the magnetic valve, a measurement of the resistive voltage drop caused by the valve current provides a good indication of the presence of slag in the tap stream.

In a preferred embodiment of the invention a magnetic circuit is arranged in a known manner perpendicular to the current, a resultant force thus being obtained with, or against, the tap stream. In the embodiment of the invention, the circuit and the magnet are supplied with current, preferably direct current, the voltage drop across the tap stream being arranged to be measured, and a measure of the slag contents thus being obtained. Simultaneously, the rate of tapping of the melt can be controlled in a known manner by means of the valve.

DETAILED DESCRIPTION

Figure 1:
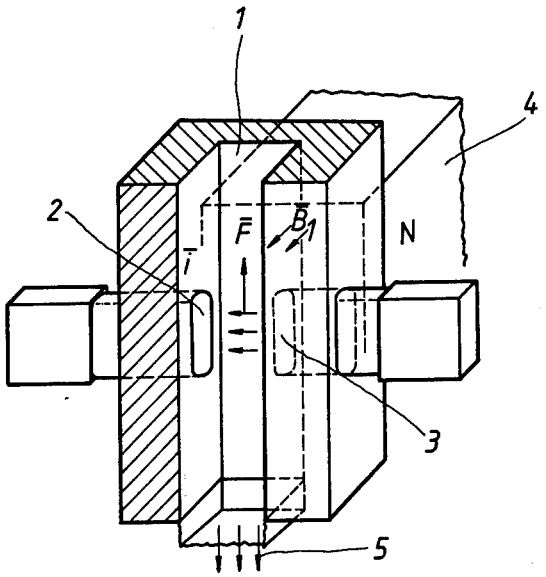
FIG. 1 shows a partial perspective view of a cross-section of the tap hole and the electromagnetic valve of the present invention.

In FIG. 1, numeral 1 shows a tap hole from a metallurgical container (not shown). Two electrodes 2, 3 are arranged at two diametrically opposed locations of the walls of hole 1, and form a circuit together with the molten metal of the tap stream between the electrodes. Magnetic circuit B is arranged at 4 perpendicular to the current in circuit i, a resultant force F thus being obtained with, or against, the tap stream flow. The magnetic circuit is supplied with direct current and alternatively with a superimposed alternating field (B~).

The electromagnetic valve may be used for continuous control of the rate of flow of a metal stream. In continuous casting, for example, it may be used in the ladle for controlling the metal flow to the tundish, or in the tundish for controlling the flow to the mold. In certain cases it also makes possible casting directly from the ladle to the mold, that is, the tundish may be omitted. The use of the valve is, however, not limited to the continuous casting process.

The two electrodes 2, 3 are water-cooled. The outflow direction of the melt is designated by numeral 5. The valve may be used both for reducing and increasing the rate of outflow. The electromagnetic valve is suitably supplied with direct current from a thyristor rectifier (FIG. 2), since in this way the inductive voltage drop in the leads are eliminated. Typical data for a valve are 0.5–1.0 $Wb/m^2$ and 5–20 kA for a valve in a ladle, that is, a valve that is capable of withstanding the ferrostatic pressure at a bath height of 3–4 meters.

Figure 2:
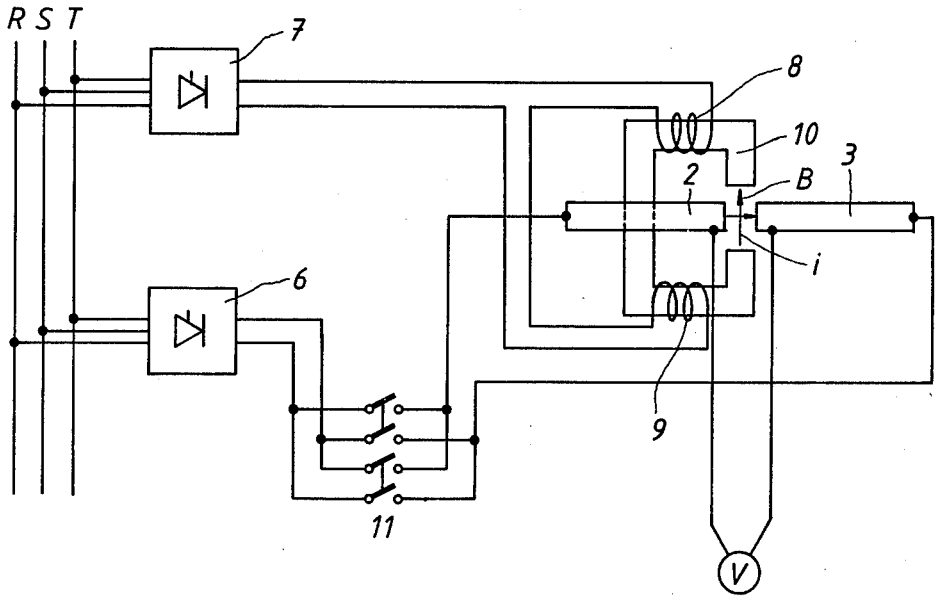
FIG. 2 illustrates the electrical circuitry for actuating the electromagnetic valve and the means for measuring the resistance through the flow of molten metal through the valve.

FIG. 2 shows a three-phase network R, S, T, to which are connected thyristor convertor circuits 6, 7, each of which includes three thyristors, one for each phase of the three-phase network. Thyristor convertor 7 is connected to excitation magnet coils 8, 9 having a magnetic iron core 10. The gap of iron core 10 forms magnetic circuit B as illustrated in FIG. 1. Current i is supplied from three-pulse convertor circuit 6 between electrodes 2, 3. The conductors from three-pulse convertor circuit 6 include reversing switch 11, to provide a means for reversing current i, and thereby force F. The voltage drop V in the gap between electrodes 2, 3 is measured by voltmeter V. As previously mentioned, the resistive voltage drop V can be calibrated to provide an indication of the slag contents in the melt stream flowing between electrodes 2, 3.

The most simple connection is obtained if the coils for the generation of the magnetic field are placed in series with the current conductors. In this way only one rectifier is needed. Also, a device for reversing the direction of the current in, for example, the coils may be provided. However, the best regulation is obtained if separate thyristor rectifiers are used for the generation of the magnetic field as well as the current through the tap stream, as is illustrated in FIG. 2. The electromagnetic valve should be supplemented with, for example, a disc valve since the metal flow cannot be electrically reduced down to zero. In tests performed, the metal flow could be controlled ±95% from the nominal value.

By superposing a magnetic alternating flux in the magnetic circuit of the valve, among other things an induced voltage is obtained across electrodes 2, 3 and has the same frequency as the superposed flux. This voltage is directly proportional to the outflow rate of the metal and can thus be employed partly as a casting rate indicator, after integration, for indicating the total amount of cast metal E. ($E=B\sim\times V\times l$, where B~ is the superposed magnetic flux, V is the rate of flow in the casting stream and l is the distance between the conductors.)

If the magnetic valve is provided with a casting rate indicator, however, the following voltages are obtained across the live electrodes: A resistive DC voltage drop (of an order of magnitude of 200 mV) caused by the electric current through the tap stream. An induced DC voltage (of the order of magnitude of 100 mV) caused by the rate of flow of the tap stream and the magnetic main flux. An induced AC voltage (of the order of magnitude of 10 mV) caused by the rate of flow in the tap stream and the superposed magnetic alternating field.

The resistive DC voltage may be obtained from the following procedures. The induced AC voltage is filtered. The induced DC voltage is calculated. This voltage is directly proportional to the induced AC voltage at a constant magnetic field. The induced DC voltage is subtracted from the total DC voltage across the electrodes and the result is thus the resistive voltage drop in the tap stream.

The foregoing may be expressed as follows: $i \times R + B \times V \times l + B\sim \times V \times l =$ the total voltage drop between conductors 2, 3, where i is the current strength, R the resistance across the tap stream, B the DC voltage field, B~ the alternating field, V the rate of the stream, and l the distance between the conductors.

The induced AC voltage ($B\sim \times V \times l$) can be filtered, and may be fed back, amplified by a factor K (for example, $K=10$) so that $B \times V \times l = -B\sim \times V \times l \times K$, thus producing $I \times R$ which is a measure of the slag contents.

This device enables an accurate, absolute measurement of the slag contents of the tap stream. The magnitudes of the different voltages indicate that there will probably be no measurement-technical problems.

In the case of teeming from, for example, a ladle, the forces from the electromagnetic valve will vary very slowly in such a way that the tap stream is retarded at the beginning of the tapping and is accelerated at the end of the tapping. This means that the induced DC voltage will also be varied slowly. When slag suddenly emerges in the tap stream, the resistive DC voltage drop will also change very rapidly. It is therefore often sufficient for the slag indication to observe when the total DC voltage over the electrodes is suddenly changed. In this case therefore the valve does not have to be provided with a casting rate indicator.

The combination of an electromagnetic valve with a slag indicator provides a better utilization of the steel in the ladle, because when slag first starts flowing down the rate of outflow is reduced and the vortex above the tap hole then collapses. The tapping may therefore continue for some time until a new vortex is formed and the process is repeated.

The slag indicator cannot, of course, operate if the valve does not retard or accelerate the tap stream. At the end of the tapping, however, the valve is normally active so this does not present any problem.

A slag indicator may, of course, also be provided separately, that is, not in combination with an electromagnetic valve, if current is conducted through the tap stream and the corresponding voltage drop is measured.

What is claimed is:

1. A valve device to be used in tap holes for tapping molten metal from metallurgical containers, comprising: an electric circuit formed by two electrodes opening out into the molten metal in the tap hole; said electric circuit including means for measuring the resistive voltage drop across the molten metal in the tap hole, the changes in the resistive voltage drop indicating any slag contents in the molten metal;

a electromagnetic circuit arranged perpendicular to the electric current from the electrodes in the molten metal for generating a magnetic field, thus obtaining a resultant force with or against the molten metal;

means for supplying current to said electromagnetic circuit for generating a DC field;

means for superposing an alternating field on the DC field in the electromagnetic circuit to induce an alternating voltage; and means for filtering the induced alternating voltage across the metal flow.

2. A valve device as in claim 1 wherein said current is direct current.

* * * * *